US006142873A

United States Patent [19]

Weiss et al.

[11] Patent Number: 6,142,873

[45] Date of Patent: Nov. 7, 2000

[54] GAMING DEVICE

[75] Inventors: Steven A. Weiss, Las Vegas, Nev.; Robert M. Dickenson, Reddick, Fla.; Rex R. Carlson, Las Vegas, Nev.

[73] Assignee: Casino Data Systems, Las Vegas, Nev.

[21] Appl. No.: 09/159,202

[22] Filed: Sep. 22, 1998

[51] Int. Cl.[7] ..... G07F 17/34

[52] U.S. Cl. ..... 463/20; 273/143 R; 273/138.2

[58] Field of Search ..... 463/20; 273/143 R, 273/138.1, 138.2, 138 A

[56] References Cited

U.S. PATENT DOCUMENTS 5,393,057 2/1995 Marnell, II .
5,564,700 10/1996 Celona ..... 463/27

FOREIGN PATENT DOCUMENTS 5-131044 5/1993 Japan .
2 072 395 2/1981 United Kingdom .
2 083 936 3/1982 United Kingdom .
2 191 030 5/1987 United Kingdom .
2 202 984 3/1988 United Kingdom .

OTHER PUBLICATIONS

Williams Electronic Games, Inc. "Phantom Haus", Jul. 1996.

*Primary Examiner*—Benjamin H. Layno
*Attorney, Agent, or Firm*—Bernhard Kreten

[57] ABSTRACT

A gaming device and method which provides a player with an opportunity of an enhanced output based on a display of a first predetermined value on a first display which subsequently activates a second display controllable to a certain extent by the player. The second display provides the player with an enhanced credit scheme and provides the player with a second option of continuing to attempt to enhance the credit payout or retiring before an event occurs which extinguishes the bonusing feature and the award.

16 Claims, 5 Drawing Sheets

GAMING DEVICE

FIELD OF THE INVENTION

The following invention relates generally to instrumentalities and methodologies with respect to gaming devices used in casinos. More specifically, the instant invention is directed to a slot machine which affords a player greater excitement by allowing the player to make subsequent decisions with respect to wagering upon the occurrence of a special condition.

BACKGROUND OF THE INVENTION

The competition for a gaming machine player's attention has increased as the result of advances in technology and in game design creativity. Processors which drive the gaming devices have become more powerful allowing more dynamic graphic depictions and rule sets for games. In turn, this has allowed greater creativity in game design with the goal to enhance the enjoyment and sustained participation of a player stimulated by new games.

The following prior art reflects the state of the art of which applicant is aware and has included to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| PATENT NO. | ISSUE DATE | INVENTOR |
|---|---|---|
| | U.S. PATENT DOCUMENTS | |
| 5,393,057 | February 28, 1995 | Marnell, II |
| | FOREIGN PATENT DOCUMENTS | |
| GB 2 072 395A | September 30, 1981 | Kennedy |
| GB 2 083 936A | March 31, 1982 | Hurst, et al. |
| GB 2 191 030A | December 2, 1997 | Melen, et al. |
| GB 2 202 984A | October 5, 1998 | Rivero |
| JP 5-131044A | May 28, 1993 | Jidoki |

SUMMARY OF THE INVENTION

The instant invention is distinguished over the known prior art in a multiplicity of ways. At its broadest scope, a player is awarded with the opportunity for receiving credits above and beyond those credits normally available resulting from comparing a pay table (that controls the return of credits) versus a displayed outcome. Typically, the display is found on either a multiple reel mechanical device or a video monitor which simulates either multiple reels or other types of games. Consumers are well acquainted with the primary pay table that is associated with a primary game.

In the present case, the presence of a special display on the primary game allows the player to participate in a second "game" or reward opportunity, integrated with the machine. For example, in one form, the presence of a special symbol or symbols on the primary game allows activation of a reel-type device located in a high visibility area, preferably on top of the conventional machine. This second game allows the reel to spin to a stop indicating a certain value. Preferably, this value is a numeric value. If the preferred numeric value is achieved, a payout occurs instantaneously that defines a bonus which preferably is greater than its face value. For example, the numeral 100 could pay 500 credits.

On the other hand, if a value (e.g., 50) appears which is numerically less than the predetermined value (e.g., 100), the player is given the option of either receiving the credit posted (i.e., 50) or storing the value of that credit and spinning again whereupon the second or subsequent spins increments and adds to the previously displayed spin values. The object of this game, therefore, is to equal the predetermined value (i.e., 100) without exceeding it. A player can elect after each spin whether or not to retire and collect the aggregated value earned during a series of spins. Because the predetermined value pays a premium (e.g., 500) over face value (i.e., 100) and above what the regular numeric values of the aggregated subtotals are, there is the additional incentive to try and shoot for the predetermined value. On the hand, exceeding the predetermined value ends the bonus round, with total forfeiture of any accumulated aggregated subtotal.

In another form of the game, the primary game again enables a secondary game upon the appearance of special symbols on the primary game. In this arrangement, a disk divided into a plurality of sectors is rotated which allows the player to multiply the amount of credits won on the primary game by (preferably) whole numbers to therefore increase the winnings based on the multiplying factor that appears in a sector selected by a pointer and designated as the operative multiplier. For example, if the three aligned special symbols (e.g., bananas) yields 50 credits on the pay table, 2× appearing on the disk yields 100 credits. However, one of the sectors on the disk is provided with a "lose" sector which, if indicated, causes the bonus round to cease and the player to forfeit any accumulated winnings to that point.

OBJECTS OF THE INVENTION

Accordingly, it is a primary object of the present invention to provide a new and novel apparatus for gaming.

A further object of the present invention is to provide an associated method that is new and novel.

A further object of the present invention is to provide that which has been characterized above which increases the excitement the player experiences and provides a refreshing departure from common run of the mill games.

A further object of the present invention is to provide that which has been characterized above which is intuitive to appreciate, easy to understand and simple to play, thereby encouraging participation.

Viewed from a first vantage point, it is an object of the present invention is to provide a method for playing a gaming device, the steps including: accepting a wager from a player; displaying an outcome; crediting the outcome based on a pay table; evaluating the outcome for the existence of a special symbol; if a special symbol is exposed, enabling a special credit display; tabulating an award based upon a displayed value on the special credit display; allowing the player to embark upon a plurality of subsequent special credit displays until a disqualification value occurs or allowing the player to retire with the award then posted.

Viewed from a second vantage point, it is an object of the present invention is to provide a gaming device, comprising, in combination: a processor/controller; a comparator operatively coupled to the processor/controller; a memory operatively coupled to the processor/controller; a first display operatively coupled to the processor/controller; means to activate the gaming device, causing an outcome on the first display; a second display operatively coupled to the processor/controller and enabled by a predetermined outcome on the first display; and play or retire input means enabled to the second display.

These and other objects will be made manifest when considering the following detailed specification when taken in conjunction with the appended drawing figures.

DESCRIPTION OF PREFERRED EMBODIMENTS

Figure 1:
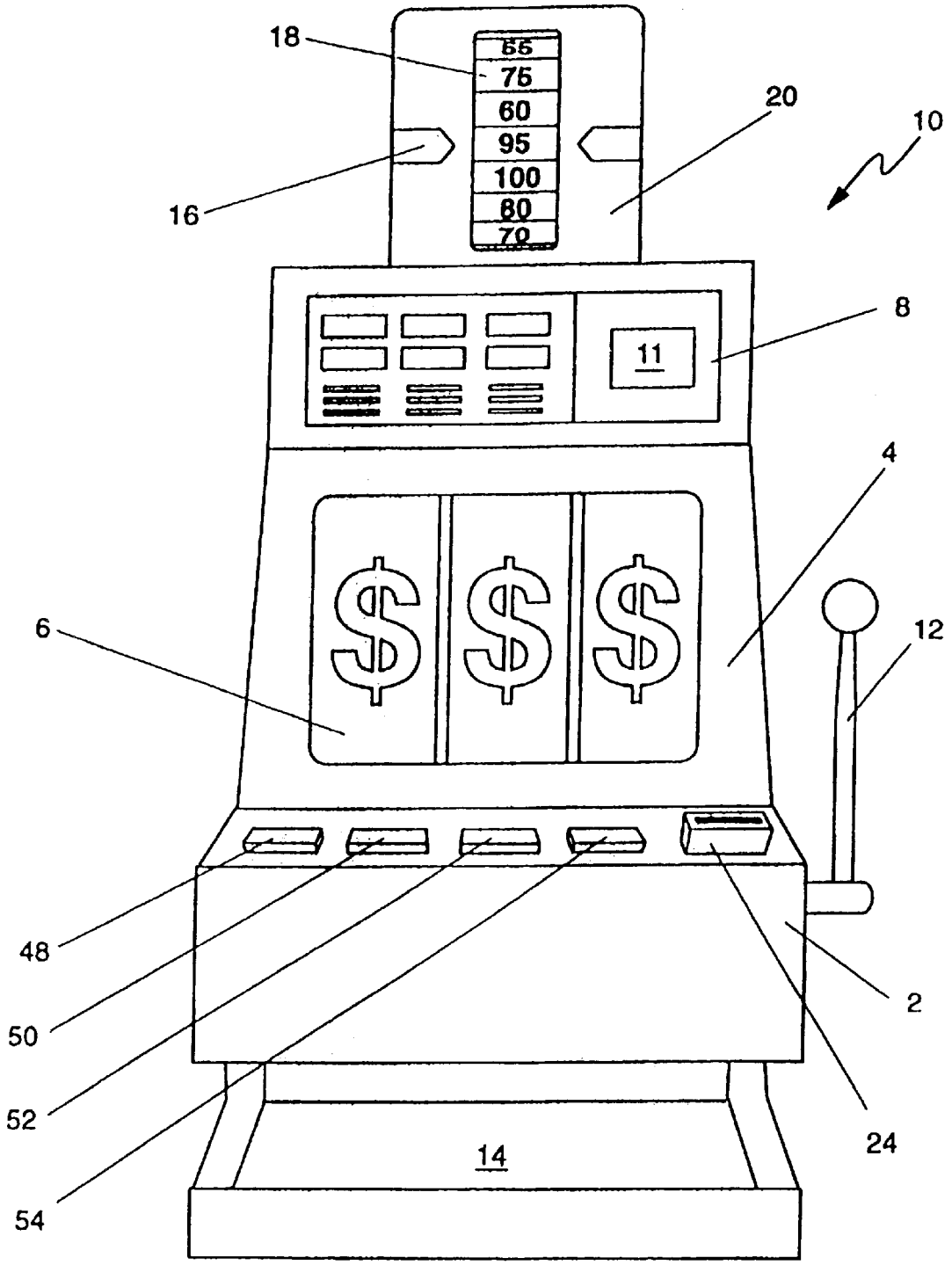
FIG. 1 is a front view of the apparatus according to the present invention for one type of game.
Figure 2:
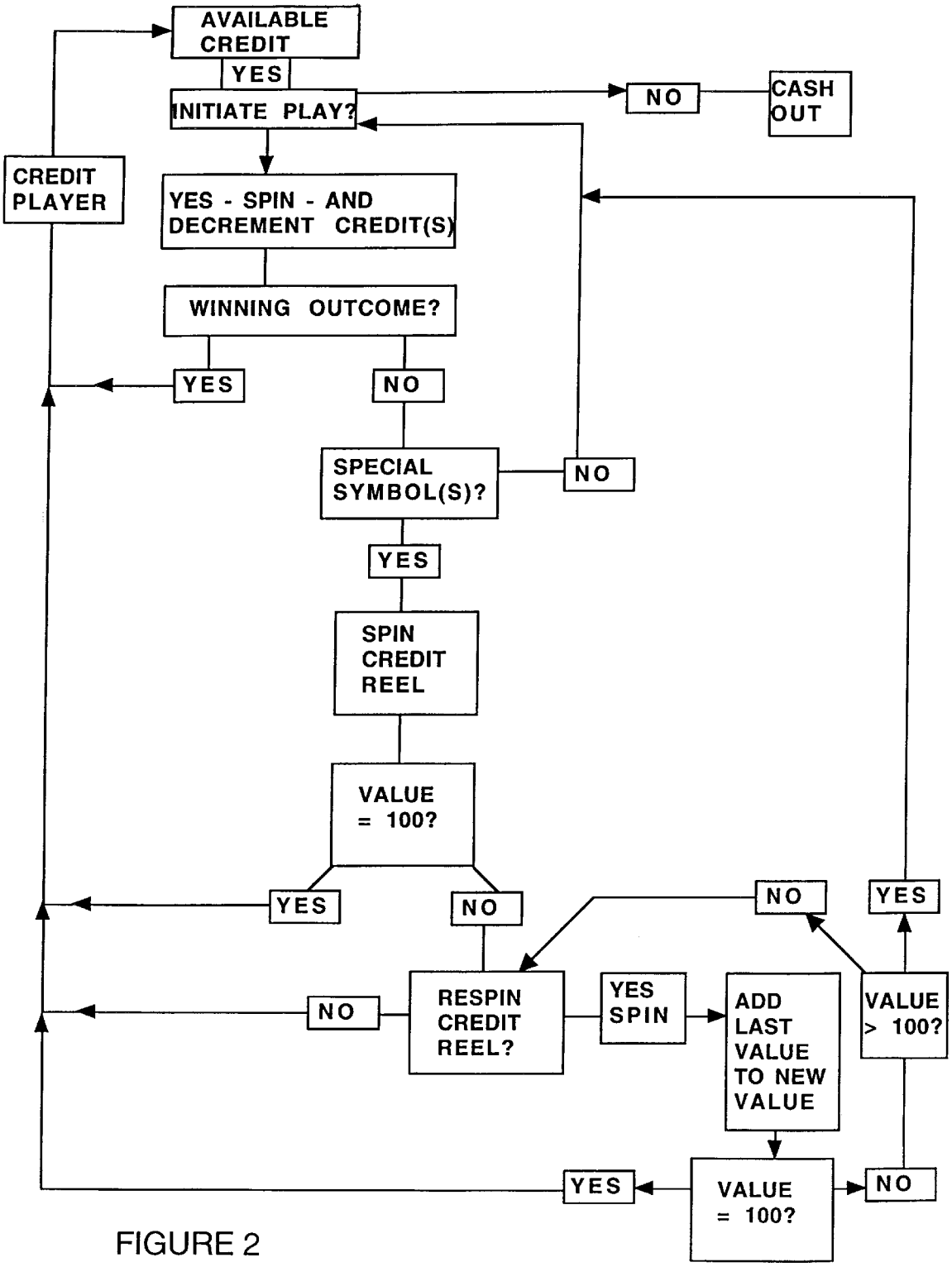
FIG. 2 is a flow chart associated with the FIG. 1 device.

Considering the drawings, wherein like reference numerals denote like parts throughout the various drawing figures, reference numeral 10 is directed to the gaming device according to a first form of the present invention.

In its essence, this device includes a gaming machine having a base 2, an upwardly extending cabinet 4 which supports and houses a first display 6. This display 6 can be a plurality of mechanical reels, mechanically driven by stepper motors 62 (FIG. 5) or can be a video monitor having simulated reel (or other graphical) motion associated therewith in its graphic package. The base 2 has a coin return tray 14 located therebelow. On one side of the machine, a pull handle 12 can actuate the reels depicted at 6. An input 24 for establishing an account with the machine can be in the forms of a coin receiver, a bill receiver and/or a card receiver to establish a surplus of funds or credits from which the player draws down. A plurality of buttons 48, 50, 52 and 54 are placed on the base 2. These buttons may have single functions or multiple functions as desired. For example, the button 54 may have the words "max bet" or "maximum bet" located thereon to indicate a maximum bet which may be necessary to engage a second display generally designated by the numerals 16, 18 and 20. The button 52 may provide an electrical bypass to engage spinning and is known as a spin button to be used in lieu of the handle 12. The spin button 52 may also be used to exercise options with respect to the second display, 16, 18 and 20 as to be described. Alternatively, the other buttons 48 and 50 may have similar functions. For example, one of the buttons (e.g., 48) may be labeled "cash out" when a player decides to cease play and 50 may be a "quit/retire" button which, when the player elects to not play the second display any further, ends bonus play as will be described. The second display includes a housing 20 within which a reel 18 is disposed therein and a plurality of pointers 16 are associated in registry with indicia on the reel correlating with a stop point synchronized with a processor/controller 64 (FIG. 5).

To initiate play, a player must first establish a balance in the player's favor and preferably press the max bet button in order to enable the first display and thus be eligible for the second display. Should the first display reflect a pre-established value (e.g., 3 "$" signs), the second display is enabled. Any outcome other than the pre-established display will cause the machine to not engage the second display, but rather pay the player based on a pay table typically located in location 8 above the first display or monitor. Should the predetermined, pre-established value appear on the first display 6, the second display 20 is enabled and a spinning cycle begins for reel 18 at which point a value is indicated on the reel 18 by the pointer 16. The object of the second display is to approach a certain value, e.g. 100 or preferably equal that value without exceeding that value. Assume that upon enablement of the second display, the first numeric value earned by the player is 10. The player can elect to receive these extra credits by pressing the retire button 50 or can elect to spin again by pressing spin button 52. A subsequent spin will cause the next value to be added to the previous value. This aggregated total can appear on display 6, an active element on pay table 8 (e.g., window 11) or a housing 20. Assume the second number shown is 60. The player then has an aggregate of 70 points and can then elect to either retire (via button 50) or spin again (via button 52) hoping to approach or equal 100 without exceeding 100. Should the player through a single spin or series of spins come to a total of 100 without exceeding 100, a jackpot is paid in excess of the nominal value of 100 (e.g., 500 credits). Should the player elect to retire while the accumulated value is less than 100, the face value of the aggregate number of the successive series of spins will be credited to the player's account. Should the player exceed the value 100 after a series of successive spins, the bonus round ends without any additional accretion in the credit account of the player and the player is invited to play the game again by using the maxi bet button enabling the first screen 6 as described above.

Figure 3:
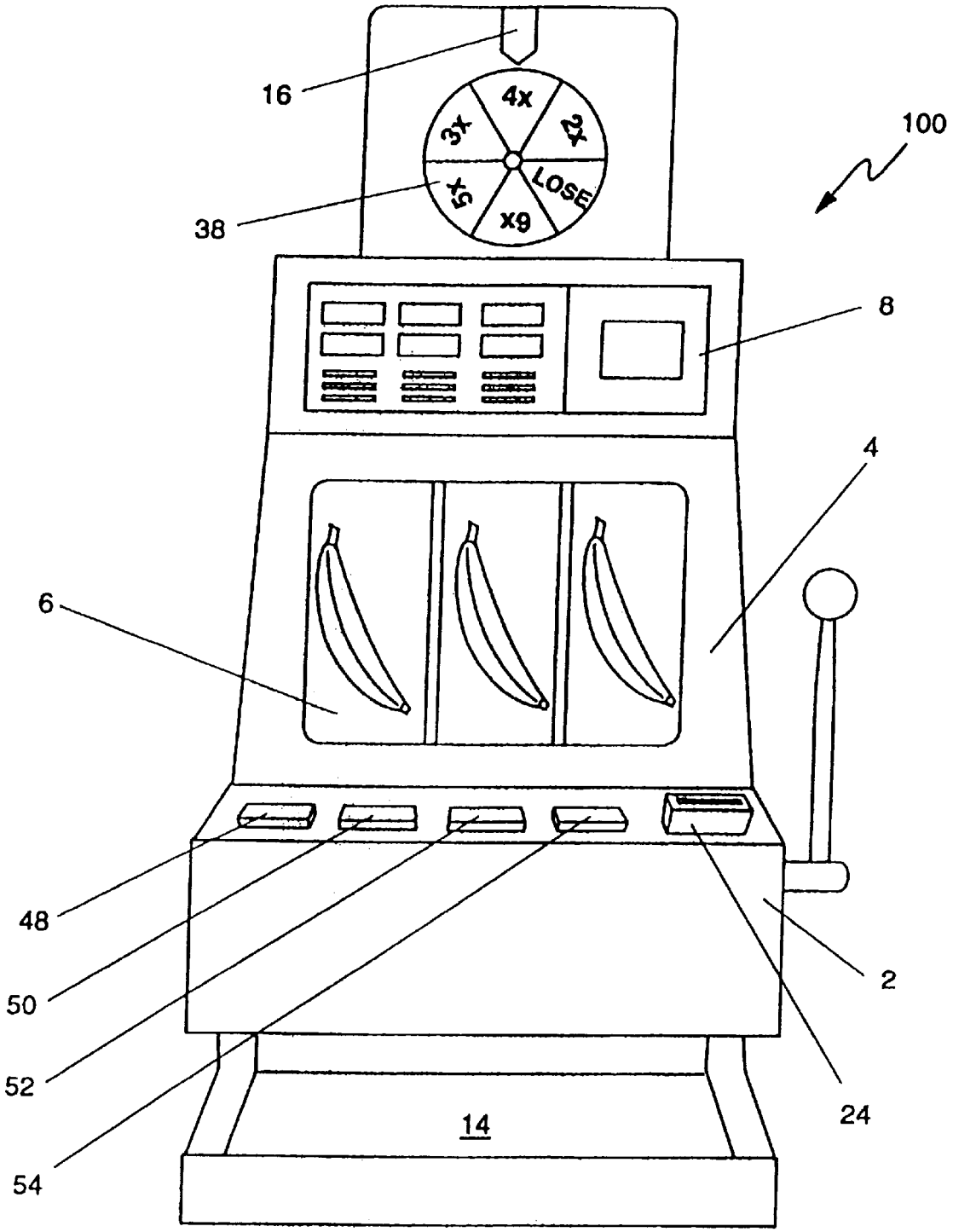
FIG. 3 is an apparatus according to the present invention with a different configuration.
Figure 4:
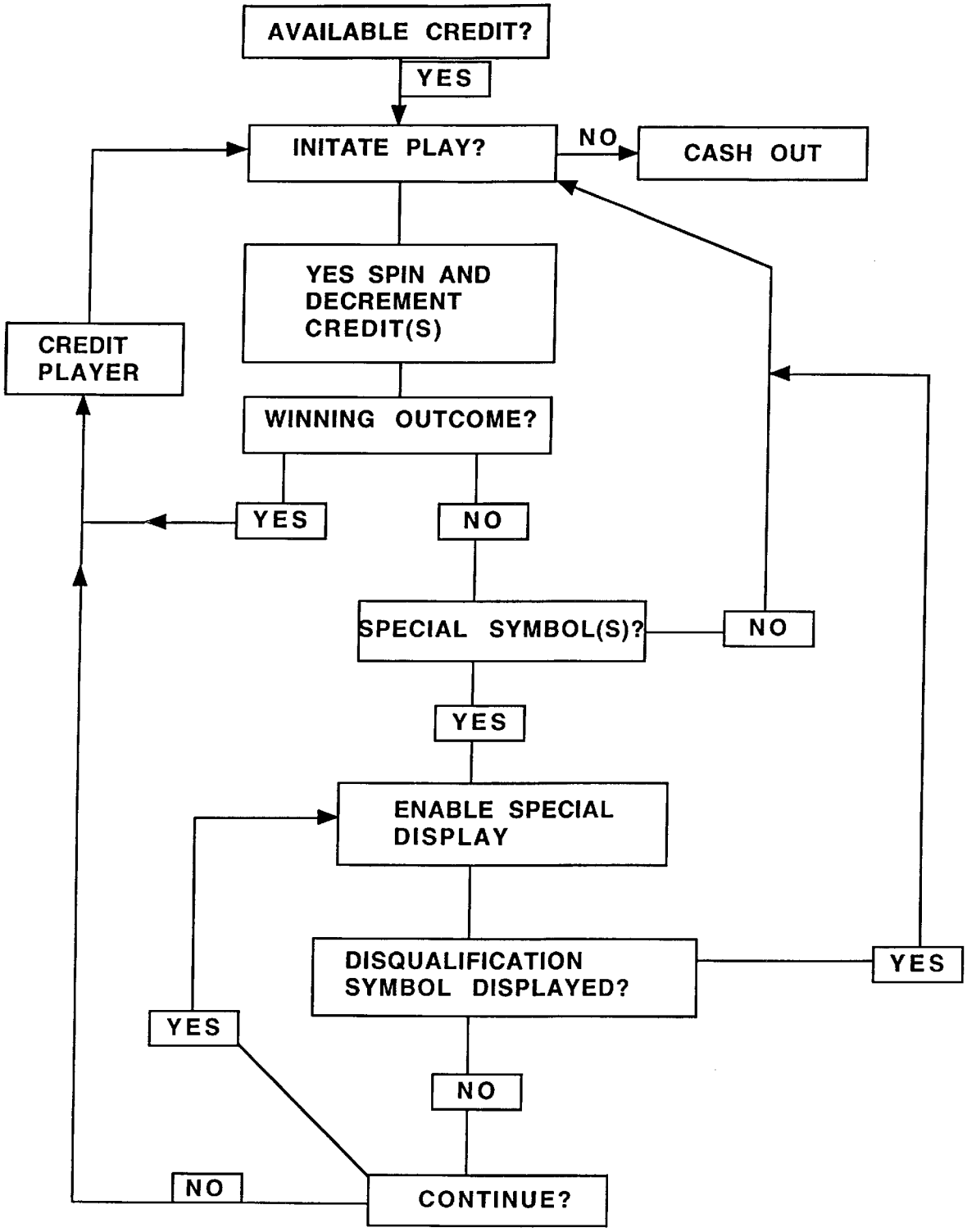
FIG. 4 is a flow chart associated with the FIG. 3 game.

Referring to FIG. 3, a second variation 100 of the machine is shown. Like numerals directed to like parts will not be belabored. As before, the first display 6 has a predetermined, pre-established value which must be obtained in order to enable the second display 20. Outcomes other than the predetermined display cause reconciliation of the first display based on the pay table 8. Should the predetermined values (e.g., three bananas as shown in FIG. 3) be obtained, the secondary display 20 is enabled. The secondary display includes a pointer 16 as before and a disc-type wheel 38 which rotates about a central axis which is horizontally disposed and projects normal from the paper. The wheel is divided into a plurality of sectors. The sectors communicate with the processor/controller and typically requires a stepping motor 60 although a video terminal could also be used as the second display in either embodiment. Each sector is suggestive of a whole number integer multiplier which will enhance the payout to the player that can be due the player based on having been provided with a display of the three bananas shown in FIG. 3. For example, assume that the initial payout for three bananas is 100 credits. Landing of the disc 38 at "4x" as indicated by pointer 16 as shown in FIG. 3 will increase the award to 400 credits. This initial spin preferably relies on the machine's automatic initial spin feature. However, subsequent spin election, by the player depressing the spin button 52, can alter the bonus payout. The player's total is not summed from successive spins but can be increased by going from 4x, for example to 5x or 6x. The player also, of course, runs the risk of receiving a lower award (e.g., 2x, 3x) and in fact has potential exposure of losing the entire amount if the sector shown with the symbol "lose" (potentially with another insignia, such as a monkey's head) stops at the pointer 16. The above methodology is illustrated schematically by the flow chart in FIG. 4.

Figure 5:
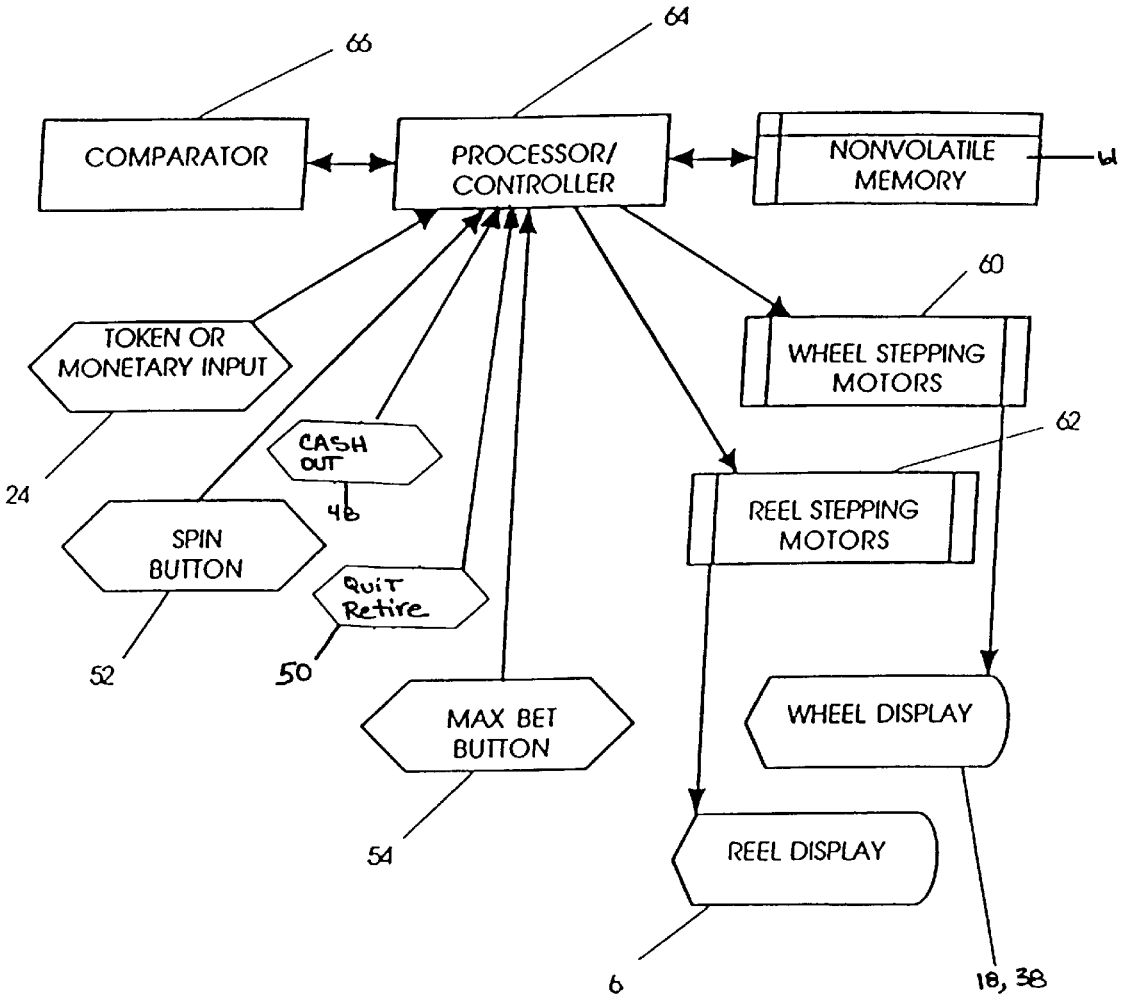
FIG. 5 is a flow chart of the gaming device hardware coupled to the FIGS. 1 through 4 structure.

FIG. 5 reflects the operative coupling of the processor/controller 64 to a comparator 66 that allows correlation between a pay table or a bonus feature and transmits same to the processor/controller. The processor/controller 64 includes non-volatile memory 61 for a plurality of purposes, one of which is to report back to a central processing unit and to provide a record of gaming device activity as a function of several parameters. The processor/controller is influenced by the spin button 52 as mentioned above and the max bet button 54 as well as being operatively conditioned by input 24 via tokens, coins, currency, credit cards or other similar instrumentalities. Quit button 50 and cash out button 48 also drive the processor/controller 64. The processor/controller also controls the first and second displays which, if mechanical contrivances are operatively coupled to stepping motors 60, 62 and, if video depictions, are driven by software by a graphic user interface emanating from the processor/controller and to the monitor displays.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A method for playing a gaming device, the steps including:

accepting a wager from a player;

displaying an outcome;

crediting the outcome based on a pay table;

evaluating the outcome for the existence of at least a special symbol;

if the special symbol is exposed, enabling a special credit display;

tabulating an award based upon a displayed value on the special credit display;

allowing the player to embark upon a plurality of subsequent special credit displays until a disqualification value occurs or allowing the player to retire with the award posted;

defining the special credit display as requiring the player to approach a numerical value but not exceed the value in order to receive an award which equals the numerical value displayed and also providing a bonus for equaling the value without exceeding the value where the bonus equals the value multiplied by an integer greater than one.

2. The method of claim 1 including crediting the player with the special credit award which the player elects to retire with prior to disqualification.

3. The method of claim 2 including having the player automatically retire when a maximum payout on the special credit display has been achieved.

4. The method of claim 3 including displaying the outcome on a first display evocative of a reel-type game.

5. The method of claim 4 including displaying the special credit displays in a manner evocative of a rotating member which stops at visibly discernible values.

6. The method of claim 5 including automatically extinguishing bonus credits heretofore available to the player when a disqualification value has been posted on the special credit display.

7. The method of claim 6 including requiring a maximum bet in order to enable the special credit display feature.

8. The method of claim 7 including defining the special credit display as requiring the player to approach a numerical value but not exceed the value in order to receive an award and providing a bonus for equaling the value without exceeding the value.

9. The method of claim 7 including providing the special credit display to the player by posting whole number integer multipliers of an award that the player can accept or decline and a losing value which extinguishes the potential payout.

10. A gaming device, comprising, in combination:

a processor/controller;

a comparator operatively coupled to said processor/controller;

a memory operatively coupled to said processor/controller;

a first display operatively coupled to said processor/controller;

means to activate said gaming device, causing an outcome on said first display;

a second display operatively coupled to said processor/controller and enabled by a predetermined outcome on said first display; said second display embodied as a rotating member which stops at visibly discernable values;

play or retire input means enabled to said second display;

wherein said play or retire input means, when selected to play, first rotates said rotating member and then stops said rotating member at said visibly discernable values plural times on demand by the player unless a maximum award is reached, and, when selected to retire by the player, terminates said second display opportunity;

said second display defined by requiring the player to approach a numerical value but not exceed the value in order to receive an award which equals the numerical value displayed and providing a bonus for equaling the value without exceeding the value where the bonus equals the value multiplied by an integer greater than one.

11. A method for playing a gaming device, the steps including:

accepting a wager from a player;

displaying an outcome;

crediting the outcome based on a pay table;

evaluating the outcome for the existence of at least a special symbol;

if the special symbol is exposed, enabling a special credit display;

tabulating an award based upon a displayed value on the special credit display;

allowing the player to embark upon a plurality of subsequent special credit displays until a disqualification value occurs or allowing the player to retire with the award posted;

including providing the special credit display to the player by posting as the special credit display whole number integer multipliers to be multiplied to the credits indicated due on the pay table as the award that the player can accept or decline and also posting as the special credit display a losing value which extinguishes the potential award.

12. A gaming device, comprising, in combination:

a processor/controller;

a comparator operatively coupled to said processor/controller;

a memory operatively coupled to said processor/controller;

a first display operatively coupled to said processor/controller;

means to activate said gaming device, causing an outcome on said first display;

a second display operatively coupled to said processor/controller and enabled by a predetermined outcome on said first display; said second display embodied as a rotating member which stops at visibly discernable values;

play or retire input means enabled to said second display;

wherein said play or retire input means, when selected to play, first rotates said rotating member and then stops said rotating member at said visibly discernable values plural times on demand by the player unless a maximum award is reached, and, when selected to retire by the player, terminates said second display opportunity;

said second display defined by posting as the special credit display whole number integer multipliers to be multiplied to the credits indicated due on the pay table as the award that the player can accept or decline and also posting as the special credit display a losing value which extinguishes the potential award.

13. The gaming device of claim 10 wherein said second display is defined by a reel placed above said first display, said second display having a pointer to locate one of plural values discernible values posted on said reel, and means to aggregate and award successive discernible values up to and including a posted maximum value.

14. The gaming device of claim 13 including means to forfeit aggregated successive values greater than said posted maximum value.

15. The gaming device of claim 12 wherein said second display is a rotating disk sequestered into pie shaped segments with a means to indicate one segment at a time, and means to multiply an integer indicated by said segment with credits due on said pay table, each said segment having a different integer.

16. The gaming device of claim 15 where one segment removes awards hereto fore due.

* * * * *